United States Patent [19]

Dorgnon

[11] 3,945,548

[45] Mar. 23, 1976

[54] PISTON ACTUATED FASTENING GUN

[76] Inventor: Roger Dorgnon, Avenue de St. Romains de Lerps 07130, Saint Peray, France

[22] Filed: Sept. 19, 1974

[21] Appl. No.: 507,310

[30] Foreign Application Priority Data

Sept. 19, 1973 France ..... 73.33548

[52] U.S. Cl. ..... 227/8; 227/10

[51] Int. Cl.[2] ..... B25C 1/14

[58] Field of Search ..... 227/8, 9, 10, 11

[56] References Cited

UNITED STATES PATENTS

| | | | |
|---|---|---|---|
| 3,172,119 | 3/1965 | Siddons | 227/8 |
| 3,248,032 | 4/1966 | Bochman, Jr. | 227/8 |
| 3,341,101 | 9/1967 | Butler et al. | 227/8 |

*Primary Examiner*—Granville Y. Custer, Jr.
*Attorney, Agent, or Firm*—Donald R. Motsko; H. Samuel Kieser; William W. Jones

[57] ABSTRACT

A powder-actuated fastening gun including a housing in which a barrel assembly is mounted for movement between a locked position and an unlocked forward position. A percussion assembly is mounted in said housing for movement between a firing position and a fired position. A rod member, external of the barrel assembly, is moveable between a forward position and a rearward position. The rod member is releasably connected to the percussion assembly. A projection on the barrel assembly is adapted to engage the forward end of the rod member and move it from its forward to its rearward position as the barrel assembly is moved from its unlocked to its locked position. Actuating means are provided for disconnecting the percussion assembly and the rod member only when the rod member is in its rearward position. A second rod member may be provided which includes a safety catch to prevent disconnection of the percussion assembly and the rod member if the second rod member has not been moved rearwardly.

5 Claims, 7 Drawing Figures

PISTON ACTUATED FASTENING GUN

This invention relates to a piston-actuated fastening gun.

In such guns, the piston usually slides into a bore in the barrel, which barrel is extended by a fastener guide, together known as a barrel assembly. In a known embodiment of such a fastening gun, the barrel guide assembly is movable with respect to a body. A breech is provided in the bore and is located forwards of a percussion assembly subjected to the action of a percussion spring. This percussion assembly cooperates with the breech to cause ignition of the charge.

The appearance of charges without a case consisting of agglomerated powder (pills) has required, in particular, the detailed study of the constitution of a chamber enclosing this pill before ignition. Thus, it has been suggested that a movable barrel cooperates through an abutment with the breech in order to simultaneously bring the gun into a position of preparation for firing and enclose the pill in a combusiton chamber provided between the barrel and the breech. The setting into position of preparation for firing of the gun implies, in particular, compression of the percussion spring. In addition, very stringent safety regulations have to be observed in order to avoid accidental firing of the charge. Regulations generally provide that this firing can only take place when the free end of the barrel assembly is in a bearing position on a wall with a force at least equal to a predetermined force. These conditions are particularly difficult to achieve in devices having remote control.

The object of the invention is to use such fastening guns with all desirable safety guarantees.

To this effect, the object of the invention is a fastening gun which employs a piston that slides in a bore of a barrel assembly, the barrel-plug-guide assembly being movable with respect to a housing. A breech is placed in a movable manner within said housing and a percussion assembly cooperates with said breech in order to cause firing. The barrel cooperates through an abutment, during its motion within said housing, with said breech in order to place the gun in a position of preparation for firing and encloses said charge in a combustion chamber provided between the barrel and the breech. The gun is characterized by the provision of at least one rod which is external to the barrel and resiliently urged back and movable with respect to the housing. The rod is engageable, at one end with a component of the percussion system projecting outside the barrel, and at its other end by a part which projects from the barrel assembly so as to cause backward motion of the percussion system and compression of the percussion spring.

According to a preferred embodiment, the member designed to actuate the barrel assembly is provided so as to communicate to it a translational motion followed by a combined translational and rotational motion and finally a pure rotational motion. The pure rotational motion gives rise to the locking of the barrel assembly with respect to the housing and breech.

Preferably, the part that overhangs the barrel assembly comprises an incline.

In order to make it possible to apply the safety regulations relating to the pressing on the gun, the latter, according to a particular embodiment, comprises a second rod which is external to the sliding barrel and is, urged back elastically parallel to the first rod. The end part of this second rod opposite the part that overhangs the barrel assembly includes a component that blocks a release member of the percussion system.

In this case, the part that projects from the barrel assembly preferably includes a bore in which is mounted a control finger subjected to the action of elastic means tending to cause it to project forwardly of said barrel assembly, said bore being arranged so as to come within the extension of said second rod in the locking position of the gun and in that position only. The finger is set up so as to allow free rotation of said barrel assembly and provide for the sliding of said second rod so as to cause the deblocking of said release member when its forward end part is brought back substantially to the level of the forward face of said overhanging part when the gun is in a bearing position.

The invention will be more clearly understood upon reading of the following description with reference to the drawing in which.

Figure 1:
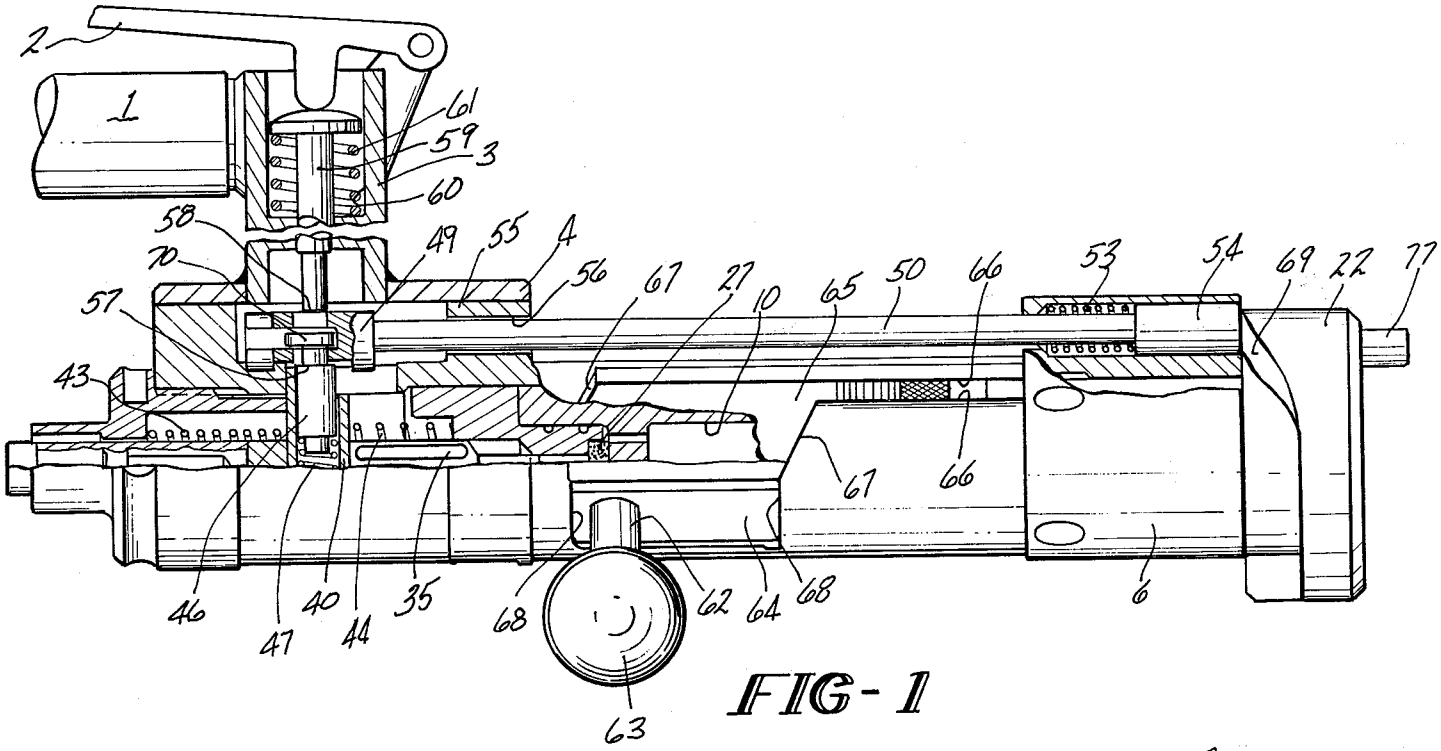
FIG. 1 is a schematic lateral elevation view partially broken away, of one example of an embodiment of a fastening gun according to the invention, the gun being cocked.

In the embodiment described and shown in the drawing, the gun is designed to be operated at a distance and it comprises a grip 1 of appropriate shape and length, as well as a trigger 2, in order to cause firing. Grip 1 is integral with a lateral projection 3 of the housing 4 of the gun.

A barrel 5, at the front of which is mounted a fastener guide 6, can move in a longitudinal bore 7 provided in a housing 4. Fastener guide 6 is screwed onto the barrel 5 and is immobilized by a socket 8 urged back by a spring 9. A longitudinal bore 10 is provided in a barrel 5 which stops towards the rear near the bottom of a blind bore 11 opening at the rear of barrel 5, bores 10 and 11 communicating through longitudinal channels having a small diameter 12. Bore 10 opens towards the front of barrel 5 and is extended in the fastener guide 6 by a coaxial bore 13 having a smaller diameter connecting to bore 10 through a truncated part 14.

A piston 15 is housed in bores 10, 13 and 14. It comprises in a known manner, a shank 16, the diameter of which is slightly smaller than that of bore 13, a truncated part 17 having the same shape as truncated bore 14 and a head 18 having a diameter very slightly smaller than that of bore 10. A fastener 19, the head 20 of which bears on the forward end of shank 16 and the tip of which bears a washer 21 which is force fitted, is fitted into bore 13 of fastener guide 6. Fastener guide 6 includes at its forward end a peripheral flange 22.

A breech 23 is movably mounted in bore 7 of housing 4. Breech 23 comprises a forward cylindrical projection 24 designed to cooperate with bore 11. The rear face of barrel 5 bears against a shoulder 25 provided at the front of breech 23 by projection 24. The forward face of projection 24 is provided with a cylindrical chamber 26 in which is housed a combustible charge 27. Chamber 26 is extended rearwards, into projection 24, through a cylindrical bore 28 communicating in turn with a bore having a larger diameter 29 which in turn opens into a bore 30 having a large diameter which in turn opens on the rear face of breech 23. A guide screw 31, the head of which 32 cooperates with a longitudinal opening 33 provided in housing 4 in order to limit the sliding motion of breech 23 and prevent its rotation, is screwed into breech 23.

A striker is located in the rear part of housing 4 of the gun, the striker comprises a percussion rod 34 which cooperates with bore 28 and a front hammer 35 cooperates with bore 29. The external surface of hammer 35 has longitudinal grooves which provides for the exhaust of combustion gases. A rear hammer 36 is provided which passes through a bore 37 provided in the rear face of plug 4′ of housing 4. An abutment 38 is screwed into the rear of the rear hammer 36 in order that the head 39 of abutment 38, through cooperation with the external periphery of bore 37, limits the forward motion of the striker. The front hammer 35 and rear hammer 36 are united through a part 40 the diameter of which is slightly less than that of bore 41 provided in the back part of housing 4 as an the extension of bore 7, a shoulder 42 being provided between these two bores.

A helicoidal percussion spring 43 is interposed between the rear surface of part 40 and the bottom of plug 4′ and surrounds the rear hammer 36. A helicoidal spring 44 bears onto the front surface of part 40 and the bottom of bore 30 while surrounding the front hammer 35. The percussion spring 43 tends, when compressed, to propel the striker forwards in order to give rise to motion of the percussion rod 34 towards charge 27 and cause its ignition. Spring 44 tends to draw breech 23 away from the percussion system in order to clear chamber 26 and provide, for the introduction of charge 27, upon loading.

In part 40 of the striker, there is provided a blind transverse bore 45, in which slides a cylindrical part 46 urged back towards the outside of part 40 by a helicoidal spring 47. At its end, opposite spring 47, part 46 comprises a head cooperating with a fork 49 integral with a longitudinal rod 50 outside the barrel and extending towards the fastener guide. The forward part of rod 50 slides longitudinally in a bore 51 provided in a radial projection 52 of housing 4. A helicoidal spring 53 tends to push the rod 50 towards the front by bearing of the back of a tip 54 covering the forward part of rod 50, this tip being provided in such a way that it can project forwardly from the front of projection 52. The forward motion of rod 50 is limited by the bearing of fork 49 against a shoulder 55 surrounding a bore 56 in which the back part of rod 50 slides. Both branches of fork 49 are provided with bores 57 and 58 respectively, the head 48 of part 46 passing through bore 57. A release part 59 sliding in a bore 60 of projection 3 of housing 4 against the action of a helicoidal spring 61, can be brought into engagement with part 46 by pressing on trigger 2. In pressing the trigger, the end of release part 59 adjacent to part 46 will pass through bore 58 of fork 49 when rod 50 is moved back towards the rear. The rearward movement of rod 50 is caused by cooperation of the front part of tip 54 and the rear of flange 22 of fastener guide 6 upon locking of the device.

In order to control this locking, barrel 5 comprises a handle 62 provided with a grip 63 fastened to barrel 5 through a rectangular plate 64. An opening 65 is provided in housing 4 with which the plate 64 cooperates in order to provide for guiding of the barrel-plug-guide assembly with respect to housing 4. Opening 65 comprises from the forward part to the rear part, a longitudinal guiding zone 66 followed by an inclined zone 67 and terminating in a transversal guiding zone 68. In zone 66, plate 64 is subjected to a translation which is followed by a helicoidal motion in zone 67 and which terminates in a pure rotational motion in zone 68. These motions are of course followed by the barrel assembly which is integral with plate 64.

During the various aforesaid motions, flange 22 of the fastener guide comes into contact with the tip 54 of rod 50 which is pushed back towards the rear during the first two phases of the motion. The backward motion of rod 50 is amplified and extended during the third phase of the motion due to the fact that flange 22 has on its rear face an incline 69 which, for example, is helicoidal. At the end of the locking operation, the barrel is locked with respect to the housing, the percussion spring 43 has been compressed due to the fact that part 46 and therefore the percussion assembly, has been pushed back rearwards by fork 49. The combustion chamber is closed around charge 16 and part 59 is opposite bore 58 of fork 49.

Figure 2:
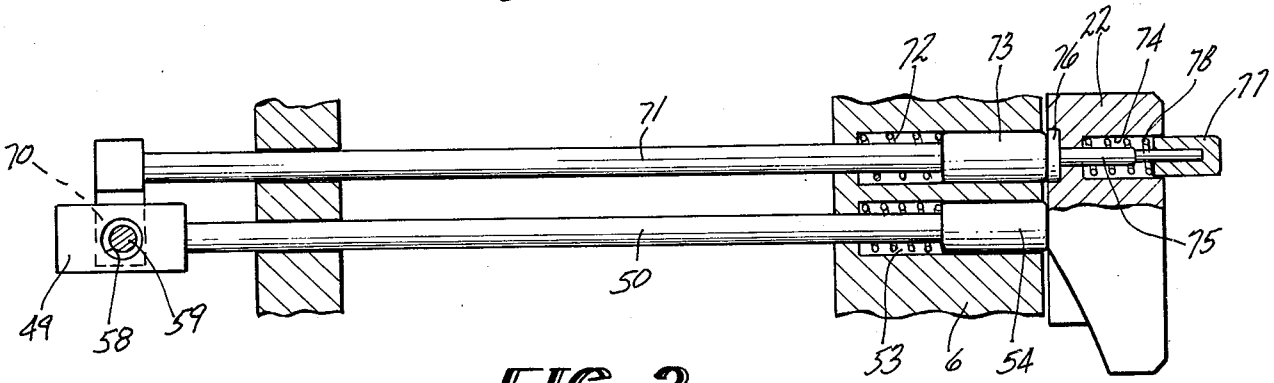
FIG. 2 is a partial sectional top view of one part of the gun according to FIG. 1, in the position shown in FIG. 1.

However, the invention provides, in addition, for the insertion between the two branches of fork 49, of a safety catch member 70 integral with rod 71 similar to rod 50. The forward portion of rod 71 slides through another bore in projection 52 against the action of a spring 72. The front end of rod 71 is capped by a tip 73 similar to tip 54. At the end of the locking operation, rods 50 and 71 have been moved back through the same distance so that the safety catch member 70 prevents part 59 from engaging and moving head 48 against the action of spring 47 (FIG. 2).

Figure 5:
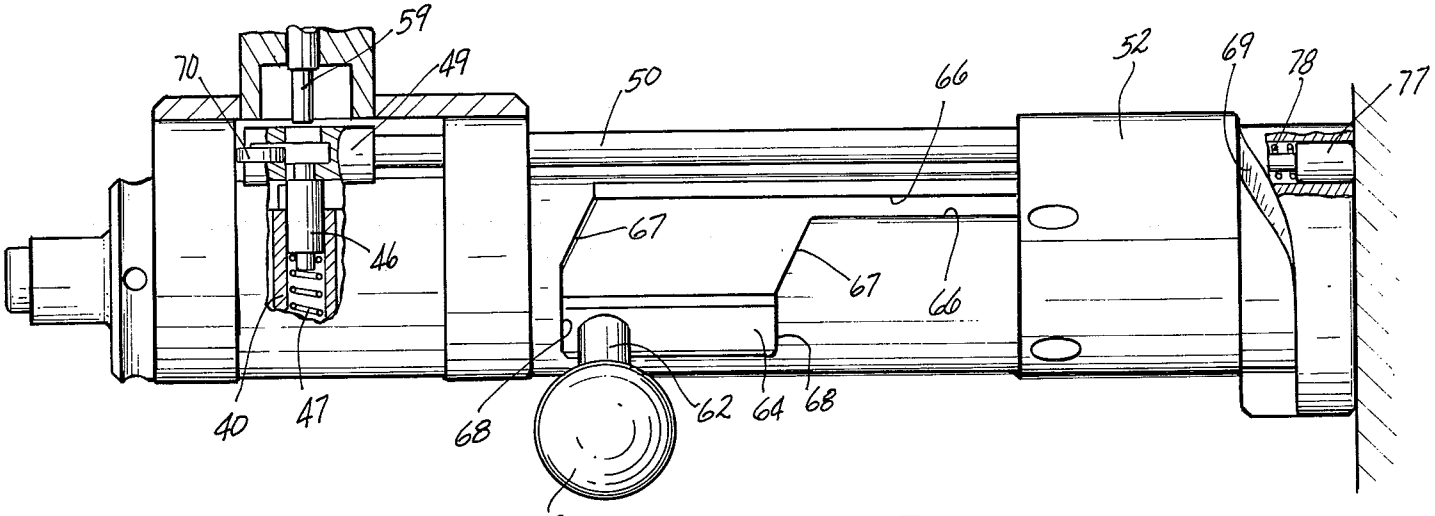
FIG. 5 is a lateral elevation view partially broken away, of the gun shown in FIGS. 1–4 bearing against a wall and ready for firing.
Figure 6:
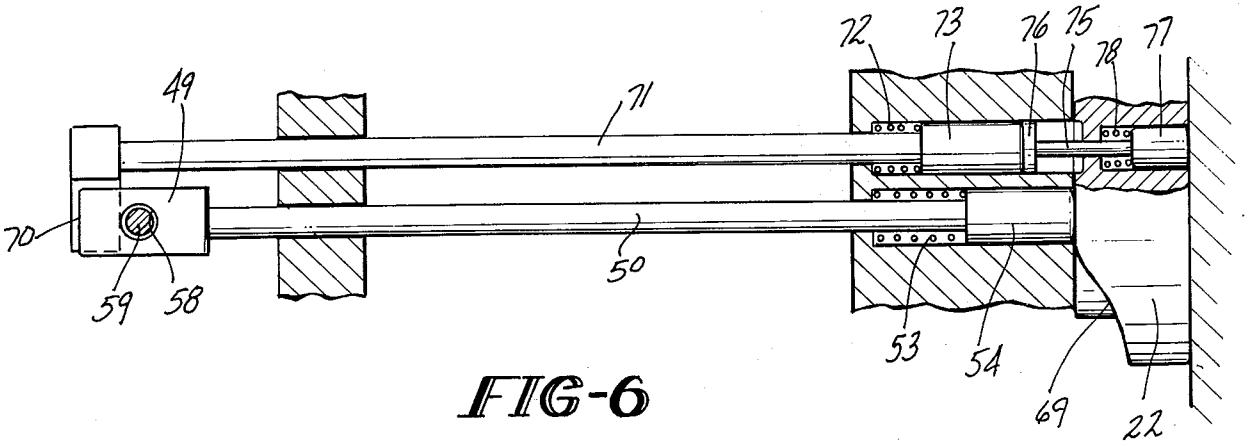
FIG. 6 is similar to FIG. 4, but for the position shown in FIG. 5.

In order to provide for the movement of the safety catch member 70, a longitudinal bore 74 is provided in flange 22 of fastener guide 6. In bore 74, is housed a sliding part 75 comprising at its rear, a head 76 bearing on the front end of tip 73 of rod 71 and integral towards the front with a projection 77 projecting forwards of flange 22 under the action of a spring 78. It is only when projection 77 is pushed in by bearing on a wall (FIGS. 5 and 6) that the safety catch member 70 is pushed back towards the rear relative to fork 49, and provides for the engagement of part 59 with part 46 to cause the depression thereof.

Figure 7:
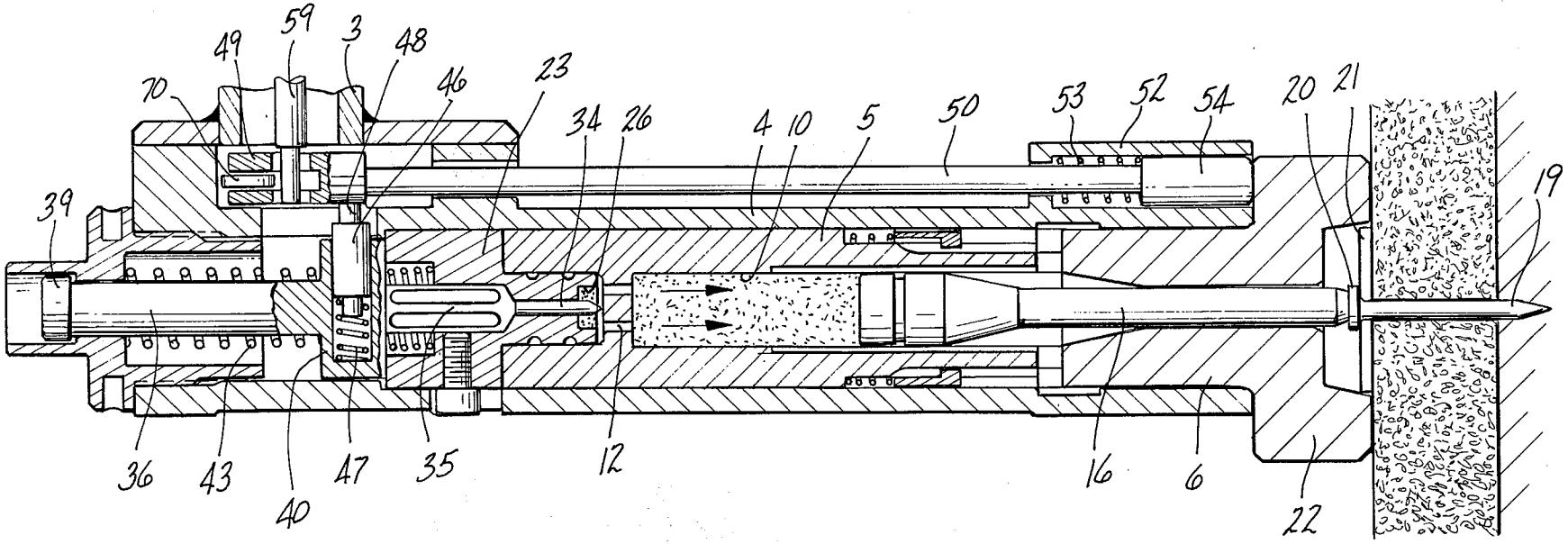
FIG. 7 is a longitudinal sectional view of the gun shown in FIGS. 1–6, after firing.

The depression of part 46 against the action of spring 47 provides for the propulsion of the striker towards the front as soon as the free end of head 48 of part 46 is cleared of fork 49. Charge 27 is then ignited. The charge combustion gases propel the piston 15 towards the front after passing through conduits 12 and the piston drives the fastener 19 into the wall. Washer 21 remains captive, at the surface of this wall, adjacent head 20 of fastener 19 (FIG. 7).

Figure 3:
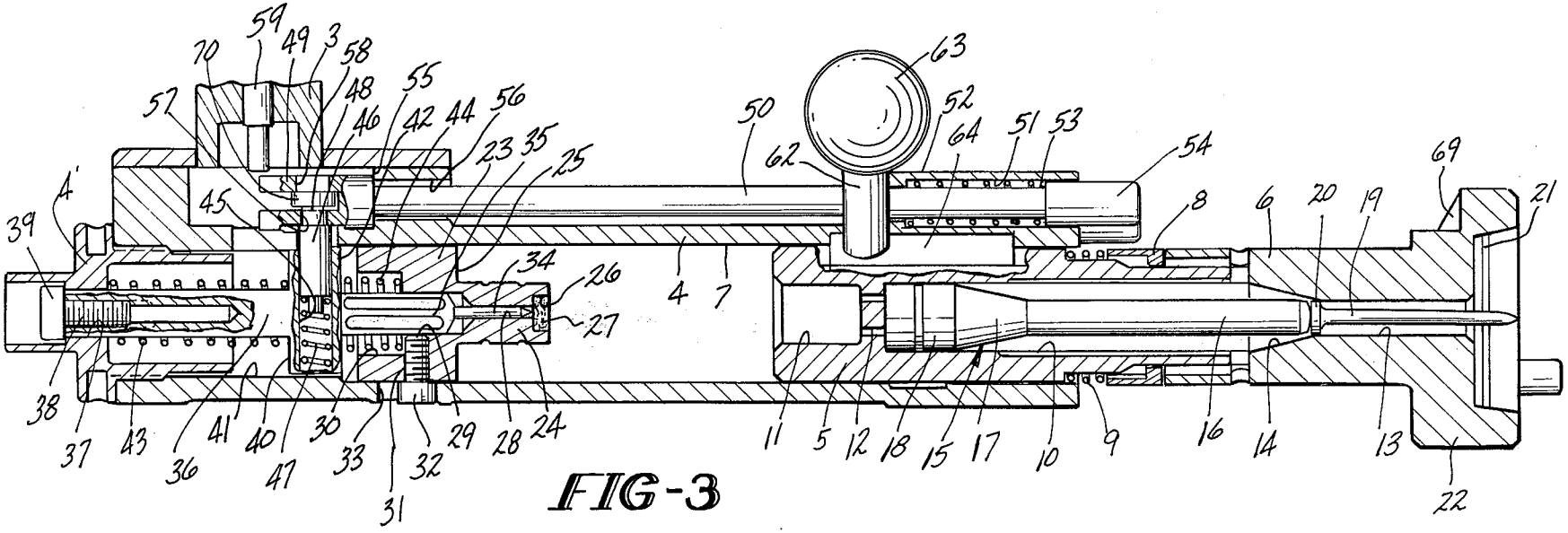
FIG. 3 is a longitudinal sectional view of the gun according to FIG. 1 before closure.
Figure 4:
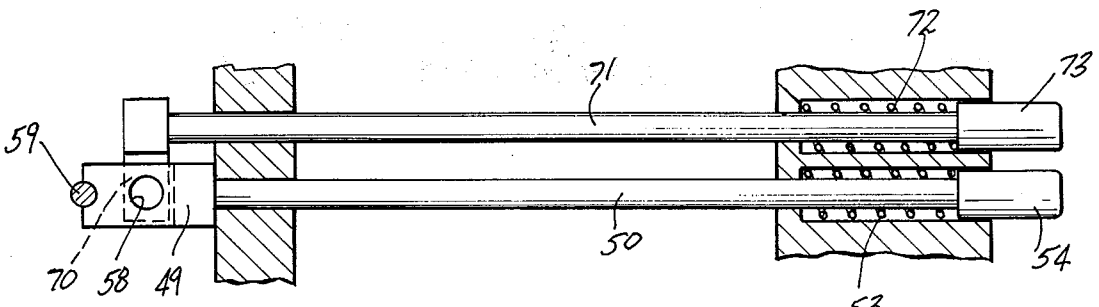
FIG. 4 is similar to FIG. 2, but for the position shown in FIG. 3, the plug-guide not being shown.

After firing and removal of the tool from the wall, the unlocking and the forward return of the barrel assembly liberates rods 50 and 71 which return to occupy their positions as shown in FIGS. 3 and 4. Part 46, under the action of its spring 47 is again introduced into bore 57. Breech 23, under the action of spring 44, retakes its forward position. The striker remains immobilized by head 39 of abutment 38. Chamber 26 of breech 23 is then accessible to receive a new piece of ammunition.

The fastening gun according to the invention can of course be provided with a control system other than the remote control system described above.

What is claimed is:

1. A powder-actuated fastening gun including a housing, a barrel assembly mounted in said housing for movement between a locked position and an unlocked forward position, percussion assembly means in said housing for initiating the ignition of a powder charge and moveable between a firing position and a fired position, a rod member external of said barrel assembly, said rod member being moveable between a forward position and a rearward position, means releasably connecting said percussion assembly means and said rod member, means projecting from said barrel assembly to engage said rod member and move it from its forward position to its rearward position as said barrel assembly is moved from its unlocked to its locked position, and means for disconnecting said percussion assembly means and said rod member only when said rod member is in its rearward position.

2. The powder-actuated fastening gun of claim 1 further including means for guiding said barrel during movement from its unlocked to its locked position, said guide means first imparting translation motion followed by combined rotational and translational motion and finally pure rotational motion, said final rotational movement causing the final locking of the barrel with respect to the housing.

3. The powder-actuated fastening gun of claim 1 wherein said projection from said barrel assembly includes an inclined surface engageable with said rod member during movement of said barrel assembly from its unlocked to its locked position.

4. The powder-actuated fastening gun of claim 1 further including a second rod member external of said barrel, said second rod member including safety catch means to prevent disconnection of said percussion assembly means and said rod member, said second rod member being mounted for movement between a forward position, an intermediate position wherein said safety catch means prevents disconnecting of said percussion assembly means and said rod member when said rod member is in its rearward position, and a rearward position wherein said safety catch means permits disconnecting of said percussion assembly means and said rod means when said rod member is in its rearward position.

5. The powder-actuated fastening gun of claim 4 further including a bore in said projection of said barrel assembly, a control finger mounted in said bore and biased into a position normally extending forward of the barrel assembly, said bore being positioned in said projection so as to be co-axial with said second rod when said barrel assembly is in its locked position, to permit the control finger to move said second rod from its intermediate to its rearward position when said control finger is moved rearwardly.

* * * * *